US012180726B1

(12) United States Patent
Munguia et al.

(10) Patent No.: US 12,180,726 B1
(45) Date of Patent: Dec. 31, 2024

(54) MASONRY GUIDING TOOL

(71) Applicants: Gilbert G. Munguia, Tucson, AZ (US); Monica M. Munguia, Tucson, AZ (US)

(72) Inventors: Gilbert G. Munguia, Tucson, AZ (US); Monica M. Munguia, Tucson, AZ (US)

( * ) Notice: Subject to any disclaimer, the term of this patent is extended or adjusted under 35 U.S.C. 154(b) by 0 days.

(21) Appl. No.: 18/638,500

(22) Filed: Apr. 17, 2024

(51) Int. Cl.
*E04G 21/22* (2006.01)

(52) U.S. Cl.
CPC ..... *E04G 21/22* (2013.01)

(58) Field of Classification Search
CPC ... E04G 21/147; E04G 21/162; E04G 21/164; E04G 21/1808; E04G 21/1841; E04G 21/22
See application file for complete search history.

(56) References Cited

U.S. PATENT DOCUMENTS 2,143,237 A * 1/1939 Byrnes ..... E04G 21/1808 33/409
2,543,716 A * 2/1951 Carini ..... E04G 21/1841 33/518
2,543,717 A * 2/1951 Carini ..... E04G 21/1841 33/518
3,091,865 A * 6/1963 Ernst ..... E04G 21/1808 33/410
3,174,227 A * 3/1965 House ..... E04G 21/22 15/235.4
3,690,614 A * 9/1972 Cherniak ..... E04G 21/22 249/95
4,093,172 A * 6/1978 Johnson ..... E04G 21/207 249/188
5,039,150 A * 8/1991 Jones ..... B65G 7/12 294/62

(Continued)

FOREIGN PATENT DOCUMENTS

AU 2007203359 A1 * 2/2009 ..... E04C 3/07
CN 105781128 A * 7/2016 ..... E04G 21/22

(Continued)

OTHER PUBLICATIONS

"Masonry Mortar Joint Spacing Tool." https://www.blockandbrickspacer.com/ [Date accessed: Oct. 23, 2023].

(Continued)

*Primary Examiner* — Ryan D Kwiecinski
(74) *Attorney, Agent, or Firm* — Bold IP PLLC; Houda El-Jarrah

(57) ABSTRACT

A masonry guiding tool for installing a block or brick into any wall or structure. The masonry guiding tool includes an angle iron with a handle connected to a bottom surface of the angle iron and one or more extended rods protruding away from the angle iron. A block or brick is positioned onto the rods and inserted into an open space in a wall needing repair. The masonry guide tool supports the block or brick in the space before the grout is added to the joint around the block or brick. The block or brick can be further positioned into the open space by adjusting the position of the block or brick using the handle of the masonry guide tool and the angle iron to hold the brick or block in place. The grout is added around the block or brick and then the tool pulled out.

15 Claims, 8 Drawing Sheets

(56) References Cited

U.S. PATENT DOCUMENTS

| | | | | | |
|---|---|---|---|---|---|
| 5,129,150 | A | * | 7/1992 | Sorensen | E04G 21/1808 33/408 |
| 5,284,000 | A | * | 2/1994 | Milne | E04G 21/22 52/749.14 |
| 5,722,176 | A | * | 3/1998 | Hinson | E04G 21/1841 33/408 |
| 5,964,073 | A | * | 10/1999 | Harper | E04G 21/20 52/DIG. 1 |
| 8,825,208 | B1 | * | 9/2014 | Benson | E04F 21/02 700/247 |
| D795,031 | S | * | 8/2017 | Jones | D8/45 |

FOREIGN PATENT DOCUMENTS

| | | | | | |
|---|---|---|---|---|---|
| CN | 107013043 | A | | 5/2017 | |
| CN | 108487652 | A | * | 9/2018 | E04G 21/22 |
| CN | 110792275 | A | | 2/2020 | |
| CN | 111088895 | A | * | 5/2020 | E04G 21/22 |
| CN | 111088895 | B | | 5/2020 | |
| CN | 111502312 | A | * | 8/2020 | E04G 21/14 |
| CN | 111779294 | A | * | 10/2020 | |
| CN | 113175228 | A | * | 7/2021 | |
| CN | 113374283 | A | * | 9/2021 | |
| CN | 113389395 | A | * | 9/2021 | |
| CN | 113404316 | A | * | 9/2021 | |
| CN | 113982292 | A | * | 1/2022 | |
| CN | 114961304 | A | * | 8/2022 | E04G 21/20 |
| CN | 117071924 | A | * | 11/2023 | |
| DE | 202009017061 | U1 | * | 4/2010 | E04G 21/16 |
| EP | 158376 | A | * | 10/1985 | E04G 21/16 |
| EP | 2821563 | A1 | * | 1/2015 | C04B 40/0616 |
| EP | 2933398 | A1 | * | 10/2015 | E04G 21/1808 |
| FR | 2805840 | A1 | * | 9/2001 | E04F 21/0015 |
| GB | 2155091 | A | * | 9/1985 | E04G 21/1841 |
| GB | 2220430 | A | * | 1/1990 | E04G 21/1841 |
| GB | 2254641 | A | * | 10/1992 | E04G 21/1841 |
| GB | 2288355 | A | * | 10/1995 | B65G 7/12 |
| GB | 2293855 | A | * | 4/1996 | E04G 21/1841 |
| GB | 2302704 | A | * | 1/1997 | E04G 21/20 |
| GB | 2449875 | A | * | 12/2008 | E04G 21/1825 |
| NL | 1014431 | C6 | * | 8/2001 | E04G 21/1808 |
| NL | 1021904 | C2 | * | 5/2004 | E04G 21/1808 |
| WO | WO-2004109040 | A1 | * | 12/2004 | E04G 21/1841 |

OTHER PUBLICATIONS

"Masonry Support," acsstainless.co.uk. https://acsstainless.co.uk/products/masonry-support/ [Date accessed: Oct. 23, 2023].

* cited by examiner

MASONRY GUIDING TOOL

FIELD OF THE DISCLOSURE

The present invention relates to a new system and apparatus for a masonry guiding tools.

BACKGROUND

Masonry is the craft of building a structure with brick, stone, or similar material, including mortar plastering which are often laid in, bound and pasted together by mortar. Currently, it is very difficult to repair a wall or other structure when a single brick or block in a wall needs to be replaced via masonry. The issue becomes that the mason or bricklayer (i.e. the specialist who is conducting the masonry work) has to cut into the healthy bricks or blocks around the damaged brick or block which then requires additional work and repair on those additional bricks or blocks.

Accordingly, there is still a need for an improved tool to allow a mason or other specialist to carefully and easily insert a block or brick in a wall using a tool that assists in the process without requiring cutting into adjacent bricks or blocks.

SUMMARY

The present description includes one or more non-limiting embodiments for an apparatus that is a masonry guiding tool. The present description includes one or more non-limiting embodiments for a masonry guide tool comprising an L-shaped angle iron, comprising a vertical element formed or attached to a horizontal element which when connected forms a general L-shape and a first extended rod and a second extended rod attached to a top surface of the horizonal element of the angle iron, wherein the first extended rod and the second extended rod extend or project outwardly way from the horizontal element, wherein the first extended rod and the second extended rod are laterally aligned with a space separating the first extended rod and the second extended rod from another. The tool may further comprise a handle attached to a bottom surface of the horizontal element of the angle iron tool. In another aspect, the vertical element is approximately perpendicularly attached to the horizontal surface or attached at a greater or lesser angle. The handle can adjust from a vertical to an angled position as attached to the angle iron. In a non-limiting embodiment, the first extended rod and the second extended rod are stationary whose position on the angle iron is not adjustable. In a non-limiting embodiment, a position of the first extended rod and the second extended rod is adjustable with respect to the angle iron such that the rods are capable of being laterally adjusted from side to side. The first groove is located on a left side of the horizontal surface of the angle iron, wherein the first extended rod is connected to the first groove. A second groove is located on a right side of the horizontal element of the angle iron, wherein the second extended rod is connected to the second groove. The handle has a circular body and projects downwardly away from the angle iron. The first extended rod and the second extended rod may be circular in shape. The first extended rod and the second extended rod each have a flattened top or support surface. The first extended rod and the second extended rod each have the same length.

The present description includes one or more non-limiting embodiments for a method of using a masonry guide tool comprising providing a masonry guide tool as described above. The method may further include inserting the first extended rod and the second extended rod into a void or open space in a wall or other vertical structure where a replacement block or brick is to be installed, positioning the replacement brick or block onto the first extended rod and the second extended rod, and pushing or sliding into position the replacement brick or block into the void or the open space by using the handle to push or slide the replacement brick or block into the void or the open space. The method may further include applying grout to the joint area, pulling out the masonry guide tool by grasping the handle of the masonry guide tool and pulling out in a backwards direction the masonry guide tool such that the first extended rod and the second extended rod are no longer positioned beneath the replacement block or brick, and applying additional grout to fill in holes left behind by the first extended rod and the second extended rod. The method may further include allowing sufficient time for the grout to dry. The method may further include storing the masonry guiding tool for additional future use. The method may further include wedging or otherwise inserting one or more shims in between surfaces of other existing blocks or bricks and one or more exterior surfaces of the replacement block or brick to adjust a thickness of a joint area. The method may further include using the handle of the masonry guide tool, adjusting the position of the replacement block or brick while within the void or the open space prior to the grouting of the joint area.

Other aspects and advantages of the invention will be apparent from the following description and the appended claims.

BRIEF DESCRIPTION OF THE DRAWINGS

Embodiments of the present disclosure are described in detail below with reference to the following drawings. These and other features, aspects, and advantages of the present disclosure will become better understood with regard to the following description, appended claims, and accompanying drawings. The drawings described herein are for illustrative purposes only of selected embodiments and not all possible implementations and are not intended to limit the scope of the present disclosure.

DETAILED DESCRIPTION

The present description is drawn to one or more exemplary embodiments for a masonry guiding tool to position and install replacement bricks or blocks on a wall or other structure. Further details are provided below with respect to the Figures.

Figure 1:
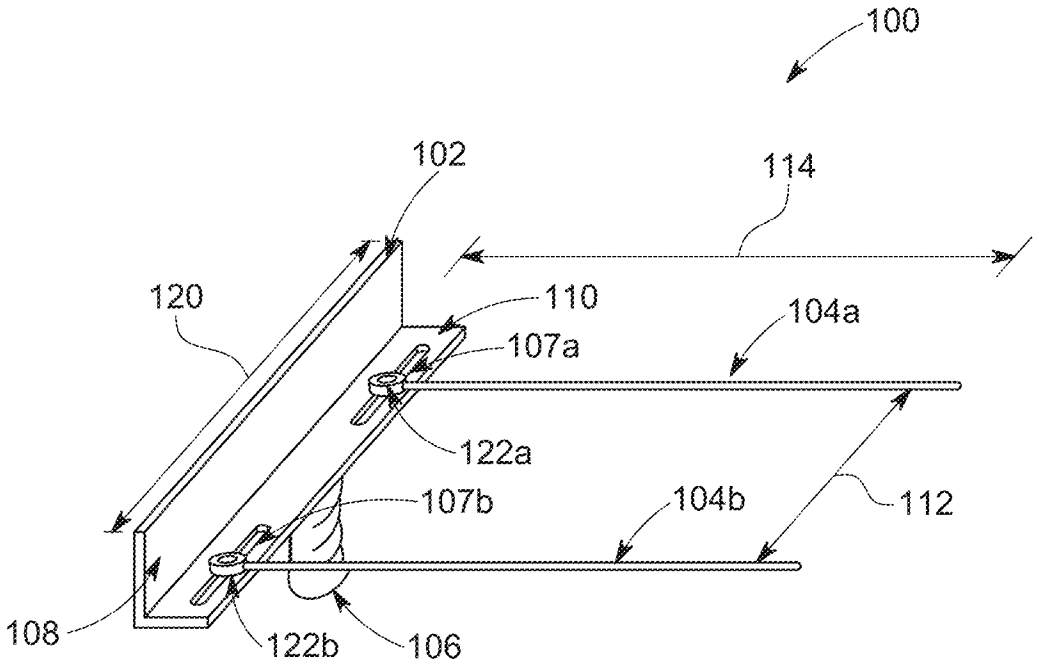
FIG. 1 depicts a pictorial illustration of a masonry guide tool.

FIG. 1 is a pictorial illustration of a masonry guide tool 100 according to one or more non-limiting embodiments. As shown in FIG. 1, the masonry guide tool 100 may comprise an angle iron 102, one or more extended rods 104*a*, 104*b*, and a handle 106 that make up the masonry guide tool 100 according to one or more non-limiting embodiments.

In a non-limiting embodiment, the angle iron 102 is comprised of two main elements, a vertical, upright surface 108 that is perpendicular to a horizontal surface 110. In a non-limiting embodiment, the length 120, as shown in FIG. 1, of the angle iron 102 may be approximately 16 inches long. The width of the vertical, upright surface 108 and the width of the horizontal element or surface 110 of the angle iron 102 may each be approximately 1½ inches.

In a non-limiting embodiment, the horizontal element 110 of the angle iron 102 may include cavities or grooves 107*a*, 107*b* as shown in FIG. 1. One or more extended holding rods 104*a*, 104*b* may have a terminal end that is held in place in the cavities or grooves 107*a*, 107*b* of the horizontal element 110 of the angle iron 102. The cavities or grooves 107*a*, 107*b* are included in the horizontal element 110 of the angle iron 102 in order to allow the extended rods 104*a*, 104*b* to have adjustable pivot points to hold an array of sizes of block, such as block or brick 206. The cavities or grooves 107*a*, 107*b* may be machine cut or otherwise cut or formed into the horizontal element 110 of the angle iron 102. In a non-limiting embodiment, the rods 104*a*, 104*b* can be moved side to side or laterally within the confines of the grooves 107*a*, 107*b*. This will give the user the ability to adjust the spacing or distance between the rods 104*a*, 104*b* and the gap 112 between each rod 104*a*, 104*b* so as to be able to accommodate larger sized blocks or smaller sized bricks. The user can bring the rods 104*a*,104*b* closer together so as to reduce the gap 112 or space the rods 104*a*, 104*b* farther apart so as to increase the gap 112. The rods 104*a*, 104*b*, in a non-limiting embodiment, may be held in place with wing nut fasteners that can be screwed on or off regularly if the user wants to adjust the position of the rods 104*a*, 104*b* within each respective groove 107*a*, 107*b*. The use of the wing nut fasteners that removably screw the underside of the connection piece of each rod 104*a*, 104*b* in place in each groove 107*a*,107*b* allows the user to selectively tighten in place and hold the rod 104*a*, 104*b* at a desired position and distance from each rod 104*a*, 104*b*. In another non-limiting embodiments, the connection piece of each rod 104*a*, 104*b* in the grooves 107*a*, 107*b* may be welded in place and may be non-removable.

As noted below, the rods 104*a*, 104*b* may also be capable of being entirely removed and reassembled using a wingnut fastener or another fastener to screw in place in the grooves 107*a*, 107*b*. When the rods 104*a*, 104*b* are removed, the user may be able to store the removed rods 104*a*, 104*b* and the angle iron 102 and attached handle 106 in a separate storage bag for the user to be able to carry the entire masonry guide tool 100 in the storage bag for easy storage and carrying from site to site.

In a non-limiting embodiment, the angle iron 102 is integrally formed as a single unit with the vertical element 108 molded with the horizontal element 110. The angle iron 102 may be formed such that the vertical element 108 is a single unit and formed with the horizontal element 110 at approximately a right angle. It may be preferable for the angle iron 102 to form a general L-shape, such that the vertical element 108 is at a generally or approximate right angle with the horizontal element 110. It is noted that in one or more non-limiting embodiments, the vertical element 108 may be at a greater or lesser angle than a right angle with respect to the horizontal element 110. Alternatively, or additionally, there may be fasteners that fastenably attach the vertical element 108 to the horizontal element 110.

The extended rods 104*a*, 104*b* project outwardly away from the horizontal element 110 of the angle iron 102. In a non-limiting embodiment, the extended rods 104*a*, 104*b* may have a length 114 of approximately 18 inches. Other lengths 114 may alternatively be used instead of the 18 inches shown in other non-limiting embodiments. In a non-limiting embodiment, the rods 104*a*, 104*b* may be a smooth rod made of metal. An exemplary, non-limiting diameter for each rod 104*a*, 104*b* may be ⅜ inch. A space or gap 112 between each rod 104*a*, 104*b* which is generally oriented parallel to each other. The rods 104*a*, 104*b* are connected or attached to the angle iron 102 as shown by the terminal ends 122*a*, 122*b*. In a non-limiting embodiment, the rods 104*a*, 104*b* may be attached via fasteners that connect to an underside of the horizontal element 110. Examples of such fasteners may include wingnuts or other types of nuts. The rods 104*a*, 104*b* may be made of metal or plastic or a combination thereof or additional materials in one or more non-limiting embodiments. In a non-limiting embodiment, the rods 104*a*, 104*b* may have a circular profile. In other non-limiting embodiments, the rods 104*a*, 104*b* may have a flattened profile and not a circular profile and/or a more rectangular shaped profile. In a non-limiting embodiment, the extended rods 104*a*, 104*b* have a fixed, straight position whose position cannot be adjusted. In other non-limiting embodiments, the extended rods have an adjustable position such as for example via the integrated grooves 107*a*, 107*b* in the horizontal element 110 of the angle iron 102.

It is noted that in a non-limiting embodiment, the space 112 between the rods 107*a*, 107*b* may be approximately 9 or 10 inches apart which may be well suited to hold a sixteen inch cement block. In other cases, the rods 107*a*, 107*b* may be set to be closer together or made to be closer together to hold smaller sized bricks.

Figure 3:
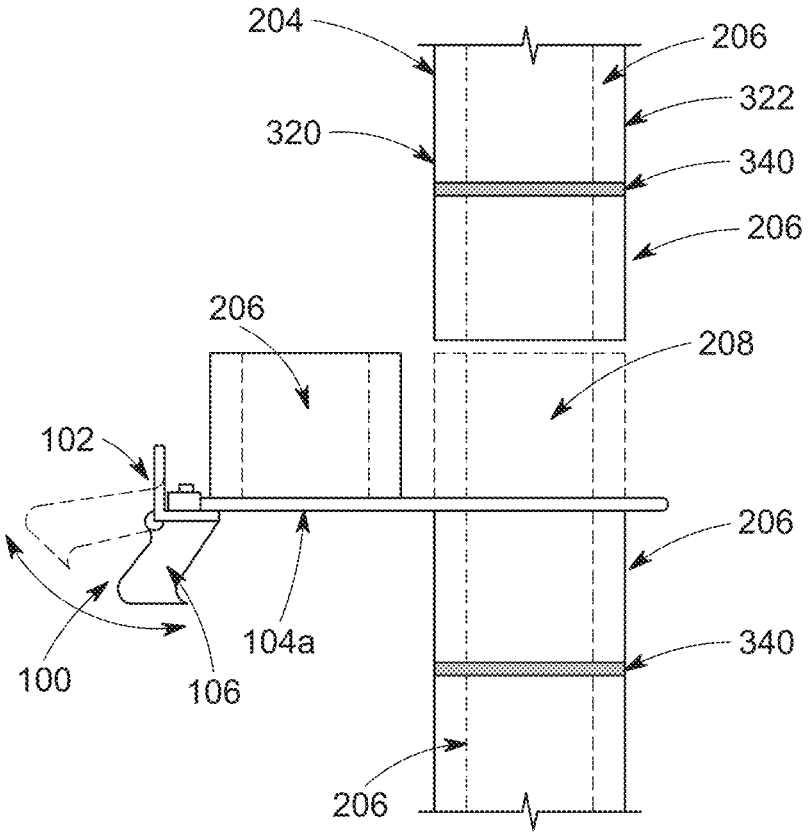
FIG. 3 depicts a side, partial view of a wall having a set of blocks and the masonry guide tool installing a cement block in the wall.
Figure 4:
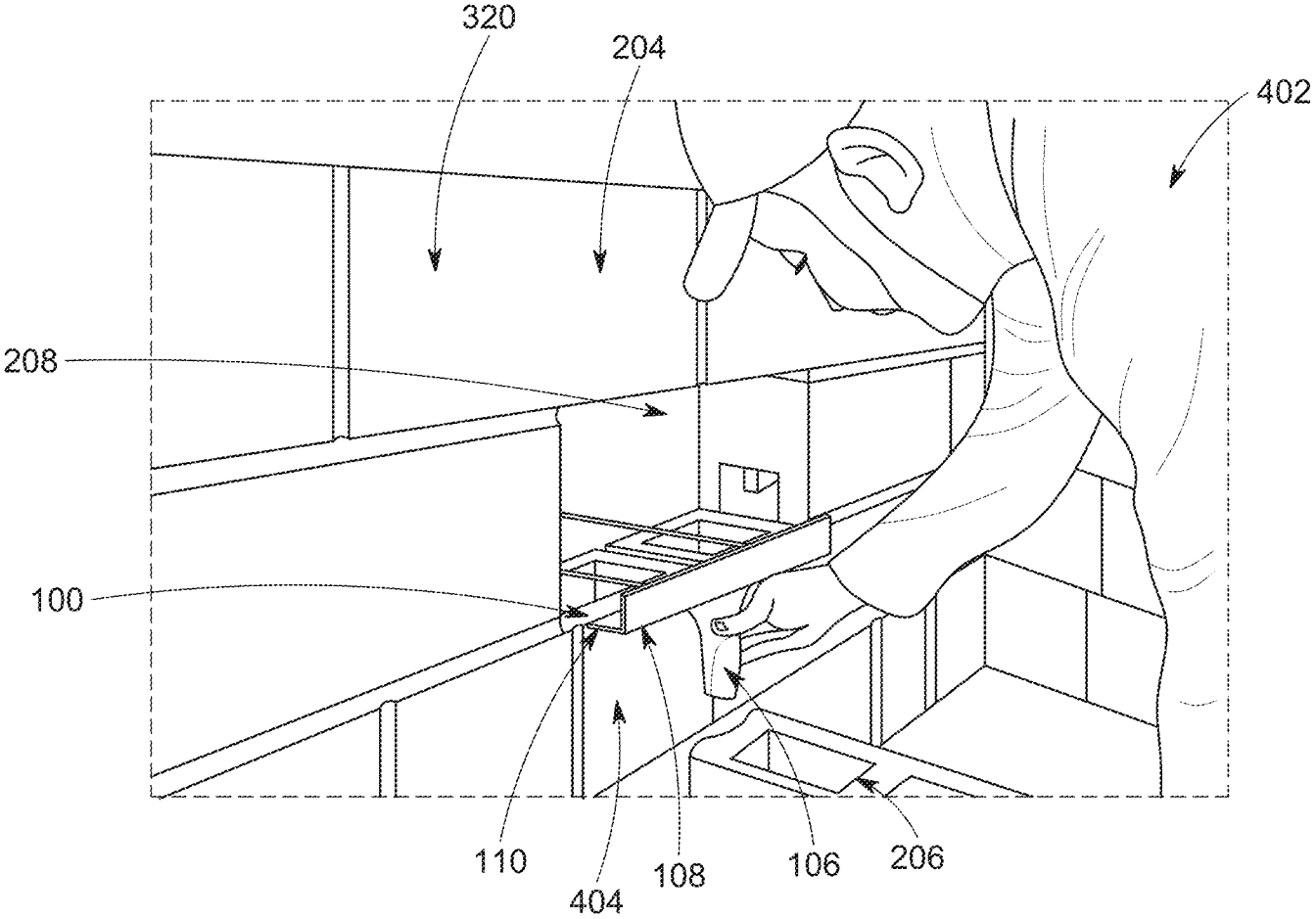
FIG. 4 depicts a pictorial illustration of a user positioning the masonry guide tool into an open space in a wall.

In a non-limiting embodiment, a handle or grip 106 descends from an underside of the horizontal element 110 of the angle iron 102 and is useable as a handle or grip to make it easier for the user (e.g., user 402 as shown in FIG. 4) to hold the masonry guide tool 100 as a single tool or unit. In a non-limiting embodiment, the handle 106 has a circular body that makes it easy for the user 402 to grasp and hold with a single hand. The handle 106 may be permanently and/or removably affixed to an underside of the horizontal element 110 of the angle iron 102 of the masonry guide tool 100. The handle 106 may be attached via adhesives or another means of attachment in one or more non-limiting embodiments. In a non-limiting embodiment, the handle or grip 106 can be adjustable and orients vertically down as shown in FIG. 1 and in FIG. 2 or can be pulled backwards at an angle as shown in FIG. 3 to provide a different gripping angle for the user 402. In a non-limiting embodiment, the handle 106 may be attached to the back of the vertical element 108 and/or to the underside of the horizontal element 110 via a hinge such as exemplary hinge 250 shown in FIG. 2.

It is noted that each rod 104*a*, 104*b* may be an individual single unit. Further, that the L-shaped angle iron 102 may be a single, complete unit that is coupled to a single handle 106 in one or more non-limiting embodiments. The rods 104*a*, 104*b* may be separately removable in one or more non-limiting embodiments or may be fixedly (not easily removable) from the L-shaped angle iron 102. The handle 106 may be fixedly attached to an underside of the L-shaped angle iron 102. The handle 106 may be able to rotate up or down or at an any angle as shown in FIG. 3.

Figure 2:
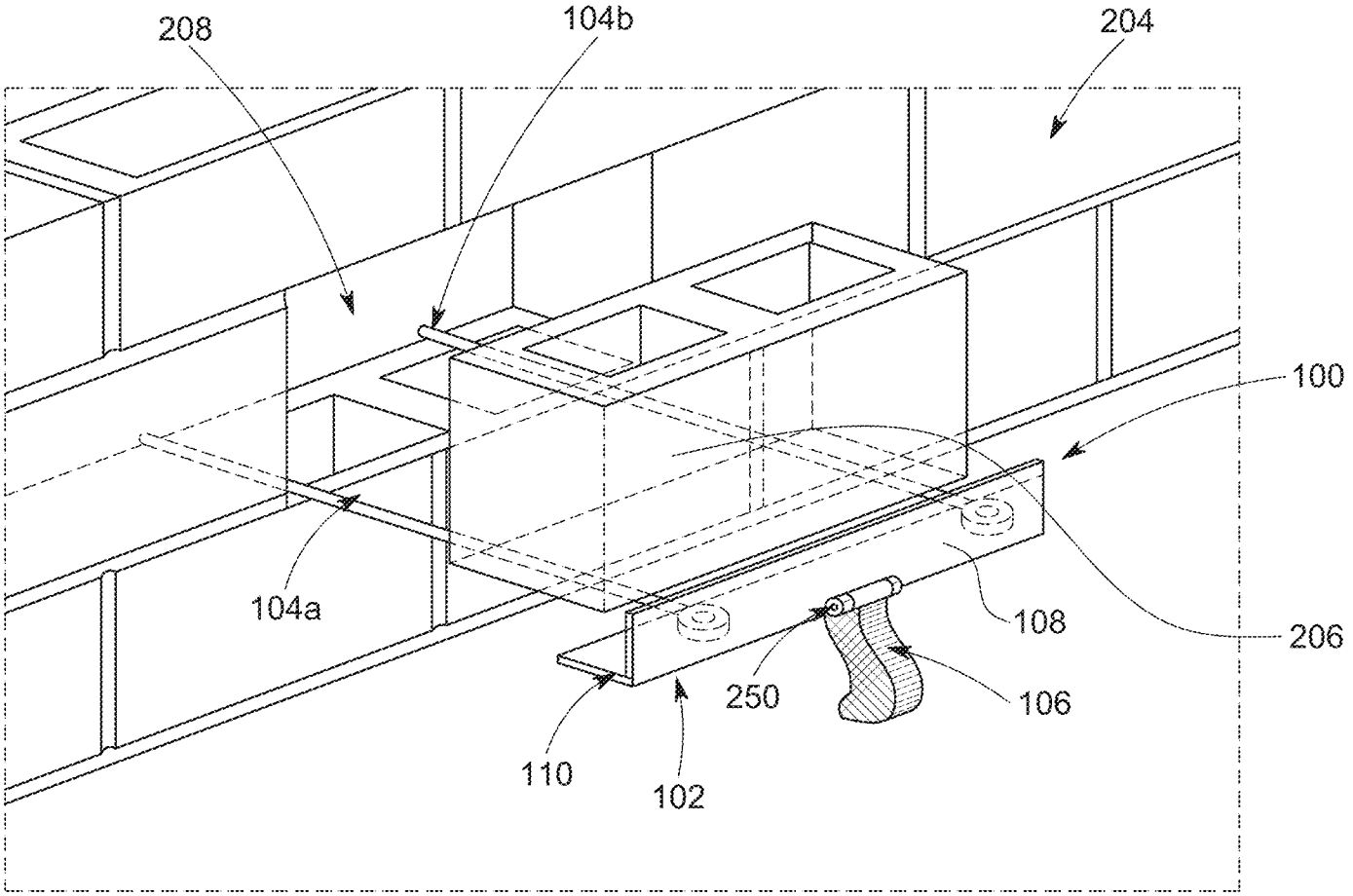
FIG. 2 depicts a pictorial illustration of a masonry guide tool being installing a cement block in a wall.

FIG. 2 shows a pictorial illustration of one or more uses of the masonry guide tool 100. The masonry guide tool 100 is useful to hold and carry blocks or bricks that need to be installed in a wall or other structure. The blocks may be blocks such as block 206 as shown in FIG. 2. Alternatively, bricks can also be positioned on the masonry guide tool 100 and held by the masonry guide tool 100 in place in order to apply grout 340, as shown in FIG. 3, around the joint or space that exists when the block or brick 206 is initially inserted into place on a wall or other structure. In a non-limiting embodiment, the block 206 and/or brick may also be referred to as a C.M.U type of block or a concrete masonry unit block. The blocks or bricks may be of varying sizes and may or may not be made of or include cement and/or concrete. In a non-limiting embodiment, the blocks may range in size and dimensions from 6 in×8 in×16 in to 8 in×8 in ×16 in to 12 in×8 in×16 in. Additional applications and sizes of blocks and bricks are also able to be positioned on the masonry guide tool 100 and the user 402 may use the masonry guide tool 100 to advantageously install and/or repair or replace damaged blocks or bricks in a wall structure.

As noted above, bricklayers or brickmasons are frequently called upon to provide masonry work and install blocks or bricks in new walls or in existing walls that have damaged blocks or bricks that need repairing. A difficult issue when repairing walls with blocks or bricks is that typically the brickmason has to cut into healthy, non-damaged blocks or bricks in order to create enough space to install a block or a brick and then to apply enough grout to the joint on the front and back of the space in the wall. It can take a great deal of extra time and effort to cut into the existing, damaged wall that needs repair, manipulate the blocks or bricks into place, and apply or provide grout that covers the joints in order for the grout to dry and the replacement blocks or bricks to stay in place. The masonry guide tool 100 advantageously saves a great deal of time because the user 402 or brickmason or other type of user does not have to cut into additional blocks or bricks. Rather, the user 402 solely has to remove a single damaged block or brick at a time to be repaired. FIG. 2 and FIG. 4 show, as an example, a block or a brick shaped hole 208 in an existing wall 204. With the use of the masonry guide tool 100, the user 402 can position the block or brick 206 on the rods 104*a*, 104*b* of the masonry guide tool 100 to both hold and insert the block or brick 206 into the open space 208 on the wall 204 without having to cut or damage any other existing retaining blocks or bricks in the wall 204. The user is able to hold the handle 106, which is fixedly and in a sturdy manner attached to the angle iron 108 and hold the replacement block or brick 206 in place on the rods 104*a*, 104*b* of the angle iron 108 while inserting the replacement block 208 into the open space 208 in the wall 204 needing repair. Further details about this method, according to one or more non-limiting embodiments, are provided below with respect to FIGS. 4-7 and FIG. 8.

Notably, the masonry guide tool 100 may be used for a variety of masonry type projects and jobs without limitation. In a non-limiting embodiment, the masonry guide tool 100 may be useful when fixing or repairing patio walls, retaining walls, flush skirting on mobile homes, or for any type of repair of a wall, gate, or other vertical structure.

Figure 5:
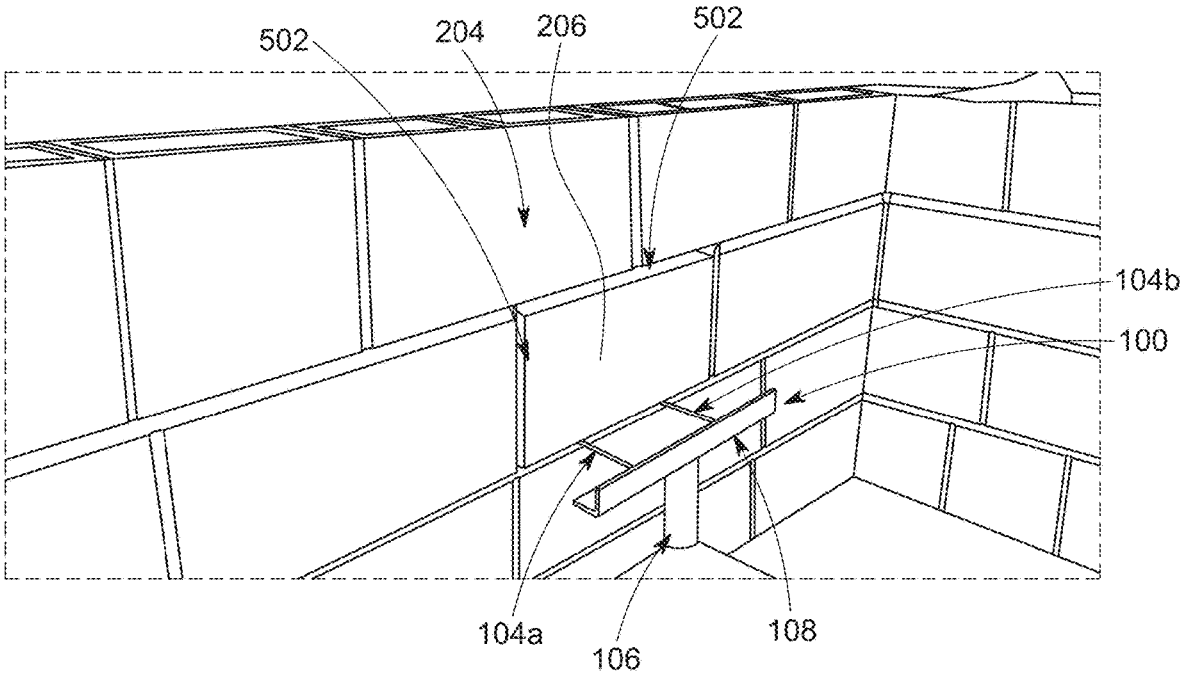
FIG. 5 depicts a pictorial illustration of a cement block held by the masonry guide tool as inserted into the open space in the wall shown in FIG. 4.

As shown in FIG. 2, the replacement block 204 is oriented in a horizontal direction and is being inserted into the open space 208 in the wall 204 needing repair. The open space 208 is going to be somewhat wider and bigger than the size of the replacement block or brick 206. This is so the user or the bricklayer or brickmason can then add grout around the joint which will then hold the replacement block or brick 206 securely in place in the wall after the masonry guide tool 100 is removed. The term "joint" as used herein refers to the joint area 502, as shown for example in FIG. 5, that the grout 340, as shown for example in FIG. 3, is intended to fill and is the area between the replacement block or brick 206 existing on all four sides of the replacement block or brick 206 requiring the grout 340 to be applied. The joint or joint area 502, as shown in FIG. 5, is also the open area between the replacement block or brick 206 and the adjacent blocks or bricks that are not being repaired or replaced.

FIG. 3 shows an example of a side, cut away view of the replacement block or brick 206 as positioned on the rods 104*a*, 104*b* of the masonry guide tool 100 being inserted into the open space 208 of the wall 204. As shown in FIG. 3, the masonry guide tool 100 may be used to insert the replacement block 206 into the open space 208 from a front side 320 of the wall 204 through to the back side or rear side 322 of the wall 204. The open space 208 does not have grout 340 yet. The user will first insert the replacement block or brick 206 and position in place and then add grout 340 to the existing joint 502 all around the replacement block 206 or brick ensuring that the grout 340 is fully covering the open joint area 502 in the front 320 and the rear side 322 of the wall 204 to make sure that the replacement block 206 or brick is securely held in place by the grout 340. The rods 104*a*, 104*b* advantageously extend over an extended distance through the open space 208 from the front side 320 of the wall 204 through to the back side 322 of the wall 204 and support the replacement block 206 or brick in place before the grout 340 is added and allowed to dry a minimum period of time before the replacement block 206 or brick is securely held in place in the wall 204 and after the masonry guide tool 100 has been pulled out or removed.

FIGS. 4-7 provide a pictorial illustration of an exemplary process of using the masonry guide tool 100. As shown in FIG. 4, there is an open space 208 the size of a block 206 in the wall 204. The user 402 has removed the previously damaged block and is intending to replace the space 208 with a replacement block 208. Prior to installing the replacement block or brick 206, the user 402 may clean the void 208 where the new or replacement block or brick 206 is to be installed using the masonry guide tool 100.

The user 402 may initially position or hold the masonry guide tool 100 by the handle 106. The user 402 may first position the masonry guide tool 100 in the open space 208 such that the rods 104*a*, 104*b* rest onto the top supporting surface of the existing block 404 or the block 404 just below where the replacement block 206 is to be inserted or positioned. As shown in FIG. 4, the user can either hold the masonry guide tool 100 from a front side 320 of the wall 204 or position the masonry guide tool 100 from a reverse side 322 if so desired or if simpler. The horizontal element 110 of the angle iron 106 is positioned touching or contacting one or more surfaces of the existing block 404 for added support. The rods 104*a*, 104*b* balance on top of the supporting surface of the existing block 404.

To insert the replacement block 206 or brick in place, the user 402 may position the replacement block 206 onto the rods 104*a*, 104*b* and push the replacement block 206 (or brick) into place using the handle 106 of the masonry guide tool 100. FIG. 5 shows an image of the replacement block 206 having already been inserted into and filling up partially the open space 208 of the wall 204. As shown in FIG. 5, the user 402 can release his or her hold of the handle 106 when the masonry guide tool 100 is balanced and the replacement block 206 or brick is in supported by the existing blocks 404 of the wall 204 even without the grout 340 having been applied to the joint area 502. The masonry guide tool 100 acts as an additional support element to support the ungrouted replacement block 206.

Figure 6:
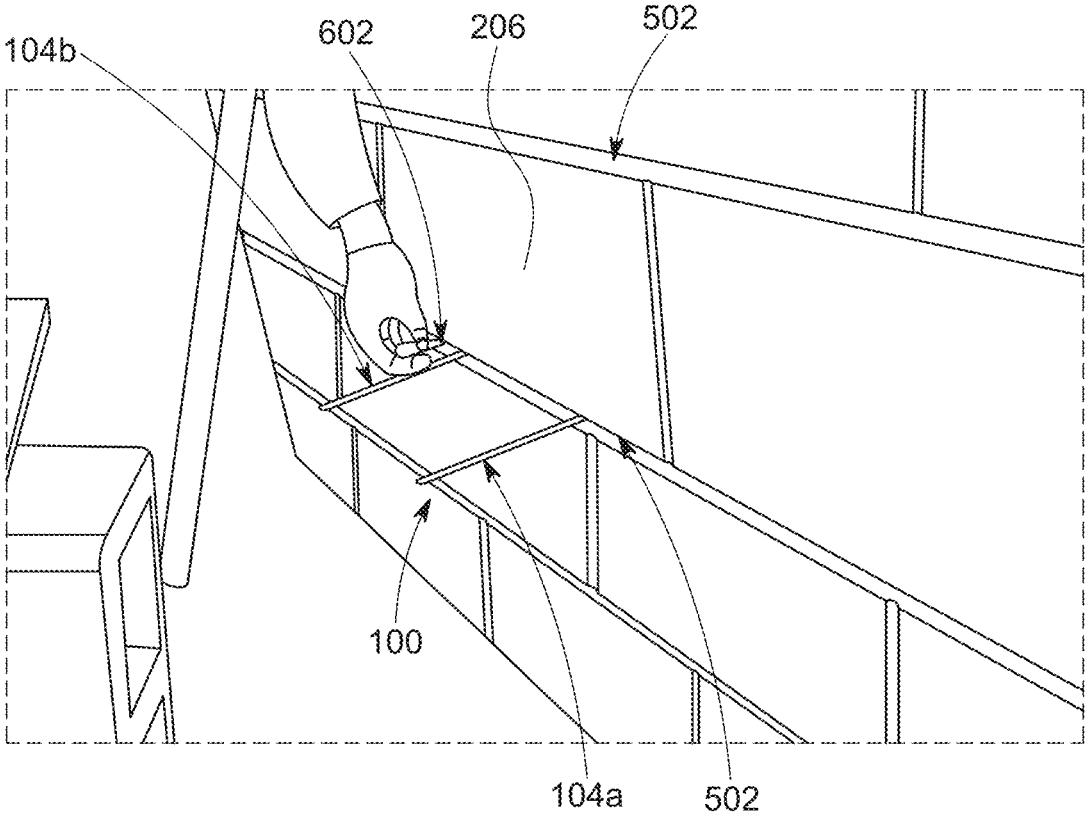
FIG. 6 depicts a pictorial illustration of a rear side of the cement block as held by the masonry guide tool as inserted into the open space in the wall as shown in FIG. 5.

FIG. 6 shows a view of the back side 322 of the wall 204. As shown in FIG. 6, the rods 104*a*, 104*b* extend through the open space 208 and past the rear side 322 of the wall 204 in one or more non-limiting embodiments to provide further support to the replacement block 206 and allow the user 402 greater reach. The user 402 may begin positioning the replacement block 206 and preparing to grout the joint or joint area 502. The user may do so by grabbing a hold of the handle 106 and shifting the position of the replacement block 206 either to one lateral side or another or forward or back or up and down if needed to center the replacement block 206 within the open space. The user 402 may further add one or more shims 602 to adjust the thickness of the joint area 502. The shims 602 can help raise the replacement block 206 up or separate the replacement block 206 from one or more left, right, or top sides of other existing blocks or bricks. Shims 602 are tapered wedges used for making slight adjustments to other elements, such as door frames, windows, or as used herein, replacement blocks or bricks 206, to make them plumb (perfectly vertical) and level. A shim 602 will fill the space between two surfaces and ensure that they are connected. The shim 602 may be a small or larger shim 602 and the user may select the thickness of the shim 602 that will appropriately adjust the thickness of the joint 502 on any particular side of the replacement block or brick 206. The shim 602 may be wedged between two surfaces as needed to raise or adjust the position of the replacement block or brick 206 so that grout 340 can still be added and a joint area 502 further defined between the replacement block or brick 206 and the overall open space 208.

Figure 7:
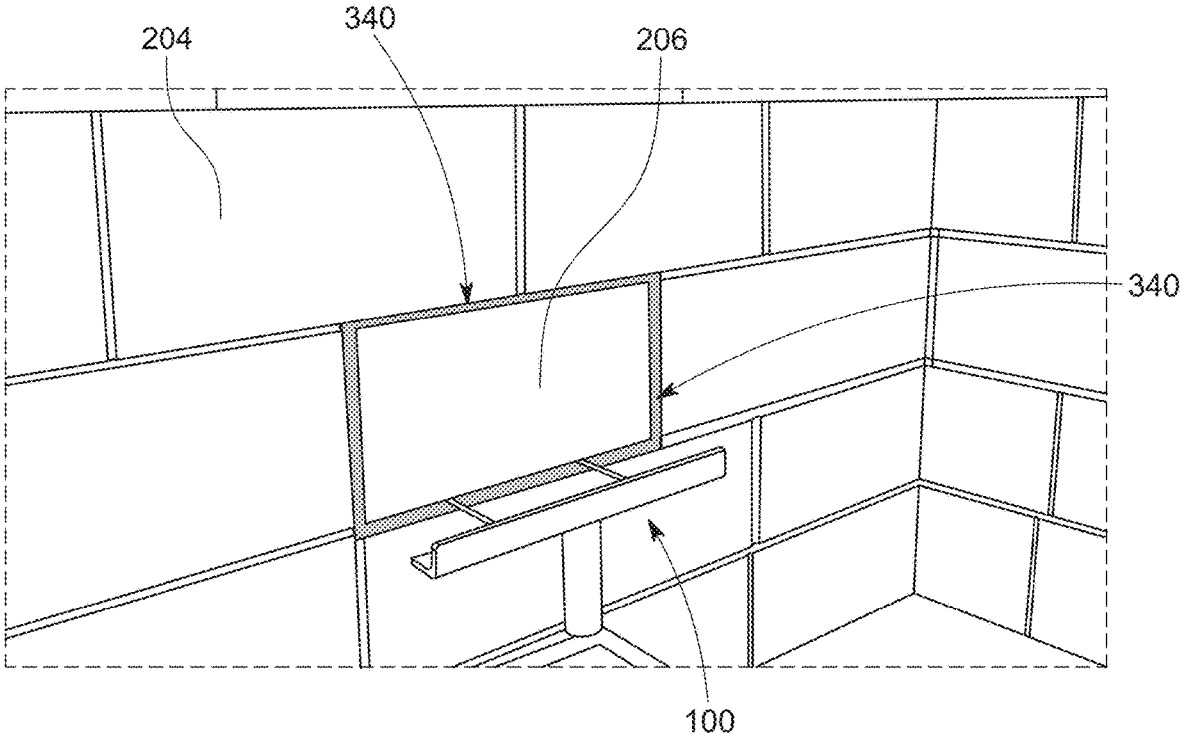
FIG. 7 depicts a pictorial illustration of grout added to the joint or the open spaced around the inserted cement block on the wall.

Once the shims 602 have been wedged in place and the replacement block or brick 206 is positioned as desired on the rods 104*a*, 104*b* of the masonry guide tool 100, the user may obtain the grout 340 and proceed to apply the grout 340 around the joint 502 area of the replacement block or brick 206. As shown in FIG. 7, the grout 340 is applied around all four sides of the replacement block or brick 206 from both front side 320 of the wall 204 and the rear side 322 of the wall 204. Accordingly, the grout 340 fully covers and seeps through the joint area 502 to fully encircle the replacement block or brick 206 with grout. Once the initial applications of grout 340 is applied using conventional grouting techniques to the joint area 502 existing on all sides surrounding the replacement block or brick 206 the user may pull out the masonry guide tool 100 by gripping the handle 106. There will be holes in the grout 340 where the rods 104*a*, 104*b* had been prior to pulling out the masonry guide tool 100. The user 402 may add additional grout 340 to fill in these holes that exist after the masonry guide tool 100 is pulled out. The user 402 may leave the replacement block or brick 206 so that the grout 340 has a sufficient and specified time to dry and to securely hold the replacement block or brick 206 in its inserted place in the wall 204.

Figure 8:
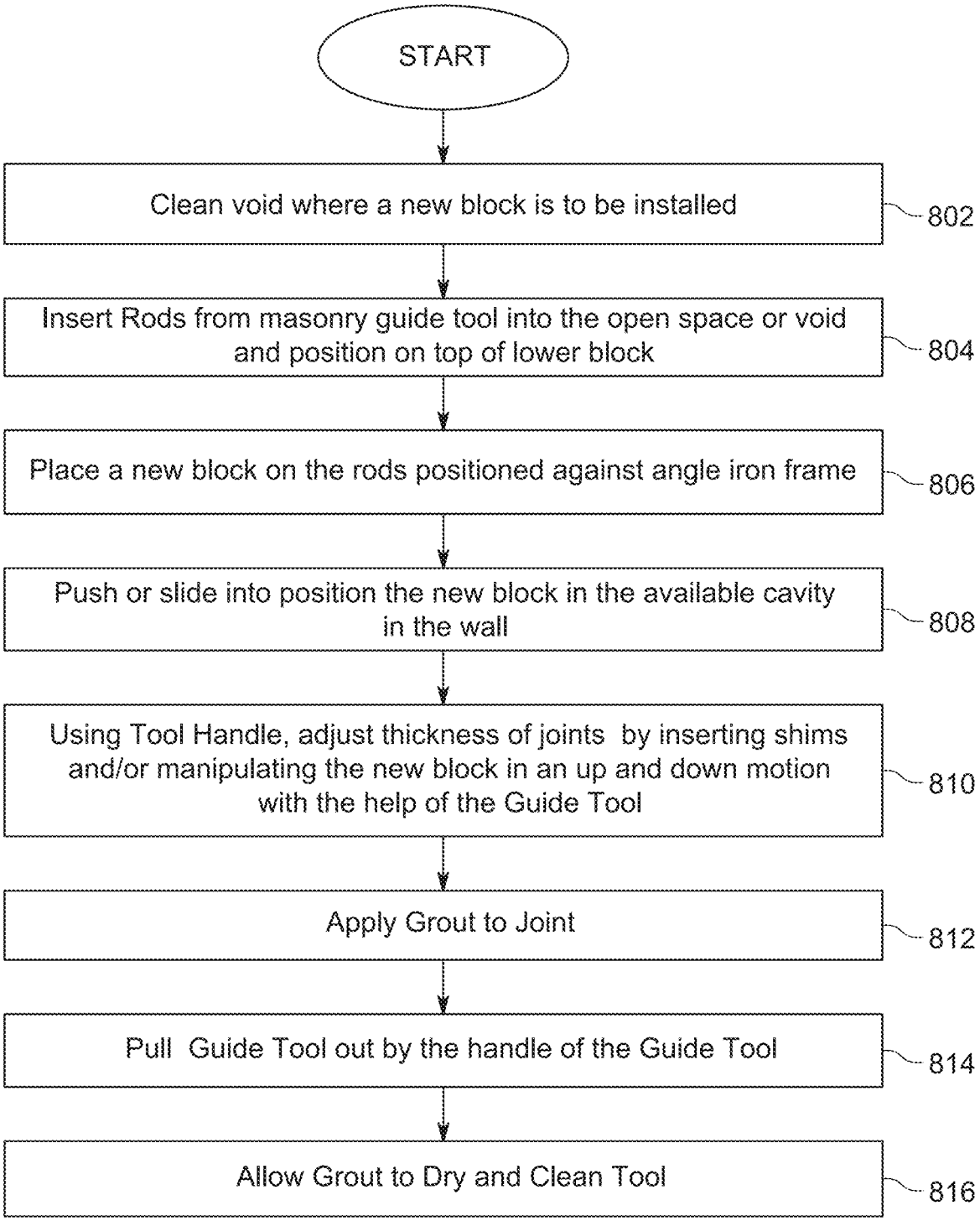
FIG. 8 depicts an exemplary flowchart for the masonry guide tool.

FIG. 8 provides a flowchart with steps for an exemplary method of using the masonry guide tool 100 to install a replacement block or brick 206. At step 802, the user 402 may proceed o clean the void where a new replacement block or brick 206 is to be installed. Next, at step 804, the user 402 may insert the rods 104*a*, 104*b* from the masonry guide tool 100 into the open space 208 and position the rods 104*a*, 104*b* on top of the supporting surface of the block or brick just below the open space 208. At step 806, the new or replacement block or brick 206 is positioned or placed on top of the rods 104*a*, 104*b* and/or against the angle iron 102 as additional support. The vertical, upright element 108 of the angle iron 102 may help provide further upright support to prevent the replacement block or brick 206 from falling off of the rods 104*a*, 104*b* of the masonry guide tool 100.

At step 808, the user 402 may push or slide into position the replacement block or brick 206 into the open space 208 in the wall 204. At step 810, using the tool handle or grip 106, the user 402 may adjust the thickness of the joints 502 by inserting shims 602 to further alter the thickness of the joints 502 and/or manipulate the position of the replacement block or brick 206 within the open space or void 208 by inserting shims 602 and/or by shaking or otherwise moving the handle 106 of the masonry guide tool 100 to adjust a position and location of the replacement block or brick 206 within the open space 208.

At step 812, the user 402 may apply grout 340 to the joint 502. At step 814, the user 402 may pull the masonry guide tool 100 out from under the inserted and grouted replacement block or brick 206. As noted above, the user 402 may then fill in the existing holes where the rods 104*a*, 104*b* were originally located with additional grout 340. At step 816, the user 402 allows the grout 340 to fully dry so that the replacement block or brick 206 is able to be fixedly inserted in between one or more other blocks or bricks 206 in the wall 204. The user 402 may further proceed to wipe off any grout 340 and/or otherwise clean the rods 104*a*, 104*b* and the angle iron 102 or the handle 106 of the masonry guide tool 100.

Accordingly, the masonry guide tool 100 as described above according to one or more non-limiting embodiments provides many benefits and advantages.

The term "at least" followed by a number is used herein to denote the start of a range beginning with that number (which may be a range having an upper limit or no upper limit, depending on the variable being defined). For example, "at least 1" means 1 or more than 1. The term "at most" followed by a number is used herein to denote the end of a range ending with that number (which may be a range having 1 or 0 as its lower limit, or a range having no lower limit, depending upon the variable being defined). For example, "at most 4" means 4 or less than 4, and "at most 40%" means 40% or less than 40%. When, in this specification, a range is given as "(a first number) to (a second number)" or "(a first number)-(a second number)," this means a range whose lower limit is the first number and whose upper limit is the second number. For example, 25 to 100 mm means a range whose lower limit is 25 mm and upper limit is 100 mm.

Certain terminology and derivations thereof may be used in the following description for convenience in reference only and will not be limiting. For example, words such as "upward," "downward," "left," and "right" would refer to directions in the drawings to which reference is made unless otherwise stated. Similarly, words such as "inward" and "outward" would refer to directions toward and away from, respectively, the geometric center of a device or area and designated parts thereof. References in the singular tense include the plural, and vice versa, unless otherwise noted. The term "coupled to" as used herein may refer to a direct or indirect connection. The term "set" as described herein may refer to "one or more" items in the singular and/or plural.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description but is not intended to be exhaustive or limited to the invention in the form disclosed. Many modifications and variations will be apparent to those of ordinary skill in the art without departing from the scope and spirit of the invention.

The embodiments were chosen and described in order to best explain the principles of the invention and the practical application, and to enable others of ordinary skill in the art to understand the invention for various embodiments with various modifications as are suited to the particular use contemplated. The present invention according to one or more embodiments described in the present description may be practiced with modification and alteration within the spirit and scope of the appended claims. Thus, the description is to be regarded as illustrative instead of restrictive of the present invention.

What is claimed is:

1. An apparatus, comprising:

a masonry guide tool, comprising:

an L-shaped angle iron, comprising:

a vertical element formed or attached to a horizontal element which when connected forms a general L-shape, wherein the vertical element is upright and protrudes above a top surface of the horizontal element, and wherein a length of the vertical element is a same length as the horizontal element;

a first extended rod and a second extended rod attached to the top surface of the horizontal element of the angle iron, wherein the first extended rod and the second extended rod extend or project outwardly away from the horizontal element, wherein the first extended rod and the second extended rod are laterally aligned with a space separating the first extended rod and the second extended rod from another; and a handle attached to a bottom surface of the horizontal element of the L-shaped angle iron.

2. The apparatus of claim 1, wherein the vertical element is approximately perpendicularly attached to the horizontal surface or attached at a greater or lesser angle.

3. The apparatus of claim 1, wherein the handle can adjust from a vertical to an angled position as attached to the angle iron.

4. The apparatus of claim 1, wherein the first extended rod and the second extended rod are stationary whose position on the angle iron is not adjustable.

5. The apparatus of claim 1, wherein a position of the first extended rod and the second extended rod is adjustable with respect to the angle iron.

6. The apparatus of claim 1, wherein a first groove is located on a left side of the horizontal surface of the angle iron, wherein the first extended rod is connected to the first groove.

7. The apparatus of claim 1, wherein a second groove is located on a right side of the horizontal element of the angle iron, wherein the second extended rod is connected to the second groove.

8. The apparatus of claim 1, wherein the handle has a circular body and projects downwardly away from the bottom surface of the horizontal element of the L-shaped angle iron.

9. The apparatus of claim 1, wherein the first extended rod and the second extended rod are circular in shape.

10. The apparatus of claim 1, wherein the first extended rod and the second extended rod each have a flattened top or support surface.

11. The apparatus of claim 1, wherein the first extended rod and the second extended rod each have the same length.

12. A method of using a masonry guide tool, comprising:

providing a masonry guide tool, comprising:

an L-shaped angle iron, comprising:

a vertical element formed or attached to a horizontal element which when connected forms a general L-shape;

a first extended rod and a second extended rod attached to a top surface of the horizontal element of the L-shaped angle iron, wherein the first extended rod and the second extended rod extend or project outwardly away from the horizontal element, wherein the first extended rod and the second extended rod are laterally aligned with a space separating the first extended rod and the second extended rod from another;

and a handle attached to a bottom surface of the horizontal element of the L-shaped angle iron;

inserting the first extended rod and the second extended rod into a void or open space in a wall or other vertical structure where a replacement block or brick is to be installed;

positioning the replacement brick or block onto the first extended rod and the second extended rod;

pushing or sliding into position the replacement brick or block into the void or the open space by using the handle to push or slide the replacement brick or block into the void or the open space;

applying grout to the joint area;

pulling out the masonry guide tool by grasping the handle of the masonry guide tool and pulling out in a backwards direction the masonry guide tool such that the first extended rod and the second extended rod are no longer positioned beneath the replacement block or brick;

applying additional grout to fill in holes left behind by the first extended rod and the second extended rod; and allowing sufficient time for the grout to dry.

13. The method of claim 12, further comprising, storing the masonry guiding tool for additional future use.

14. The method of claim 12, further comprising, wedging or otherwise inserting one or more shims in between surfaces of other existing blocks or bricks and one or more exterior surfaces of the replacement block or brick to adjust a thickness of a joint area.

15. The method of claim 12, using the handle of the masonry guide tool, adjusting the position of the replacement block or brick while within the void or the open space prior to the grouting of the joint area.

* * * * *